US009255390B2

(12) United States Patent
Park

(10) Patent No.: US 9,255,390 B2
(45) Date of Patent: Feb. 9, 2016

(54) TOILET PURGING DEVICE

(75) Inventor: Il Do Park, Gasan-myeon Pocheon-si (KR)

(73) Assignee: MIRI CO., LTD., Gyeonggi-Do (KR)

( * ) Notice: Subject to any disclaimer, the term of this patent is extended or adjusted under 35 U.S.C. 154(b) by 402 days.

(21) Appl. No.: 13/806,711

(22) PCT Filed: Feb. 10, 2012

(86) PCT No.: PCT/KR2012/001009
§ 371 (c)(1),
(2), (4) Date: Jan. 31, 2013

(87) PCT Pub. No.: WO2013/065905
PCT Pub. Date: May 10, 2013

(65) Prior Publication Data

US 2013/0198943 A1 Aug. 8, 2013

(30) Foreign Application Priority Data

Nov. 3, 2011 (KR) ..... 10-2011-0113940

(51) Int. Cl.
*E03D 9/00* (2006.01)
*E03C 1/304* (2006.01)
*E03C 1/306* (2006.01)

(52) U.S. Cl.
CPC ..... *E03C 1/304* (2013.01); *E03C 1/306* (2013.01); *E03D 9/00* (2013.01)

(58) Field of Classification Search
CPC ..... E03C 1/304; E03C 1/306
USPC ..... 4/255.04
See application file for complete search history.

(56) References Cited

U.S. PATENT DOCUMENTS 5,239,708 A 8/1993 Irwin
6,550,074 B1 * 4/2003 Allenbaugh et al. ..... 4/255.11
6,922,854 B2 8/2005 Allenbaugh et al.

FOREIGN PATENT DOCUMENTS

KR 10 1033053 B1 5/2011
KR 10 1133217 B1 4/2012
WO WO 2012138116 A2 * 10/2012

* cited by examiner

*Primary Examiner* — Tuan N Nguyen
(74) *Attorney, Agent, or Firm* — Rabin & Berdo, P.C.

(57) ABSTRACT

The present invention provides a toilet purging device that ejects gas, when a switch is operated. The toilet purging device includes a pipe body that has a gas channel through the pipe body, a firing unit that includes a firing pin disposed to be longitudinally movable and a switch for moving the firing pin to the pipe body when pushed. The firing pin is coupled to the upper end of the pipe body. The toilet purging device includes a tightening cap that is thread-fastened to the top of the firing unit with a gas container therebetween and moves the gas container to be in close contact with the firing pin when turned, and a connector that is coupled to the lower end of the pipe body and inserted into a drain pipe of a toilet.

6 Claims, 10 Drawing Sheets

TOILET PURGING DEVICE

CROSS-REFERENCES TO RELATED APPLICATIONS

This application is a National Stage of International Application No. PCT/KR2012/001009, which claims priority to Korean Patent Application No. KR 10-2011-0113940, filed Nov. 3, 2011, the entire contents of which applications is incorporated herein by this reference.

TECHNICAL FIELD

The present invention relates to a toilet purging device, and more particularly, to a toilet purging device that can eject a gas at a correct point of time to an accurate position, using a configuration that ejects a gas by operating a switch, with firing ready before ejecting the gas.

BACKGROUND ART

In order to unclog a drain or a toilet, generally, users put the sucking plate made of rubber at the end of a bar-shaped support bar to the drain-outlet of the drain or the toiler, and unclog the drain and the toilet, using pressure generated when moving up/down the support bar.

However, there is a problem in that it is difficult to unclog the drain-out of the drain and the toilet, when the sucking plate turns inside out while the support bar is moved up/down or when the pressure generated by the support bar is small.

An "unclogging device for a toilet" (Korean Patent Registration No. 10-2001-0048603) has been proposed in the related art to solve the problem.

As shown in FIG. 1, the unclogging device for a toilet of the related art includes: a gas container 110 that has an inlet sealed with a sealing plate 114 and contains a predetermined amount of gas; a body 120 that has channels formed longitudinally therein to pass a gas and a gas container seat recessed at a predetermined depth from the upper end to make the inlet of the gas container 110 in close contact; a firing pin 130 that disposed at the center of the gas container seat and allows the gas in the gas container 110 to be discharged to the channel by passing through the sealing plate; a cover 140 that has an internal space to receive the side opposite to the inlet of the gas container 110, is thread-fastened to the upper portion of the body to cover the open upper portion of the body 120, and moves the gas container 110 to the firing pin 130 by means of the thread movement when a user turns it; and a connector 150 that is connected to the lower end of the body 120 and guides the gas discharged through the channel to a drainpipe.

That is, a drainpipe is unclogged by sudden high pressure, by inserting the connector 150 of the unclogging device for a toilet into an S-trap of a toilet and turning the cover 140 such that the high-pressure gas contained in the gas container 110 is ejected to the S-trap.

There is a problem, however, in this technology of the related art in that as the gas is ejected under high pressure while the cover is turned, the gas is not ejected in a desired direction when ejected with the turn of the cover, even if the connector is accurately inserted in the S-trap.

Further, there is an interval between the point of time of starting turning the cover and the point of time of finishing turning the cover (the point of time of ejecting the gas), and thus the user has difficulty in accurately estimating the start of ejecting the gas, so the user is startled at the noise generated from the ejected gas.

DISCLOSURE

Technical Problem

In order to solve the problem, an object of the present invention is to provide a toilet purging device that makes it possible to accurately estimate the point of time of ejecting a gas and can eject the gas to an accurate position.

Technical Solution

In order to achieve the object, a toilet purging device according to the present invention includes a pipe body, a firing unit, a tightening cap, and a connector. The pipe body has a gas channel through the pipe body, the firing unit includes a firing pin disposed to be longitudinally movable and a switch for moving the firing pin to the pipe body when pushed, and coupled to the upper end of the pipe body, the tightening cap is thread-fastened to the top of the firing unit with a gas container interposed therebetween and moves the gas container to be in close contact with the firing pin when turned, and the connector is coupled to the lower end of the pipe body and inserted into a drainpipe of a toilet.

A locking bar may be connected perpendicularly to the lower portion of the firing pin and the firing unit may have a first firing channel that guides the locking bar in the width direction of the firing unit when the switch is pushed and a second firing channel that is connected in a curve shape to the first firing channel and guides the locking bar to the pipe body by means of gas pressure.

A seating groove where the gas container is inserted may be formed at the upper portion of the firing unit and a gas channel through which the firing pin moves may be formed in the firing unit to longitudinally extend and communicate with the seating groove.

The switch may be elastically connected to the firing unit by a switch return spring and the firing pin may be elastically supported to the firing unit by a firing return spring.

The firing unit may include a switch unit that is disposed with the front end protruding through the seating groove of the firing unit and is pressed by the gas container when the gas container comes in contact with the firing pin, and a power circuit unit that supplies power to a lamp unit when the switch unit is pressed by the gas container.

The firing unit may have a Z-shaped guide spring for continuously and smoothly moving the locking bar of the firing pin to the second firing channel from the first firing channel.

Advantageous Effects

According to the present invention, it is possible to implement the following remarkable effects.

First, since the gas is ejected by operating a switch after firing is ready before the gas is ejected, a user can eject the gas to a correct position after accurately estimating the point of time of ejecting the gas.

Second, since the user can make sure the ready for firing by means of the lamp unit before the gas is ejected, it is possible to safely and conveniently unclog a clogged drain and a clogged toilet.

Third, since the pipe body through which the gas flows is implemented by an integrally hollow pipe, it is possible to prevent the pipe body from being clogged with foreign substances and resist high pressure when the gas is fired.

MODE FOR INVENTION

Figure 1:
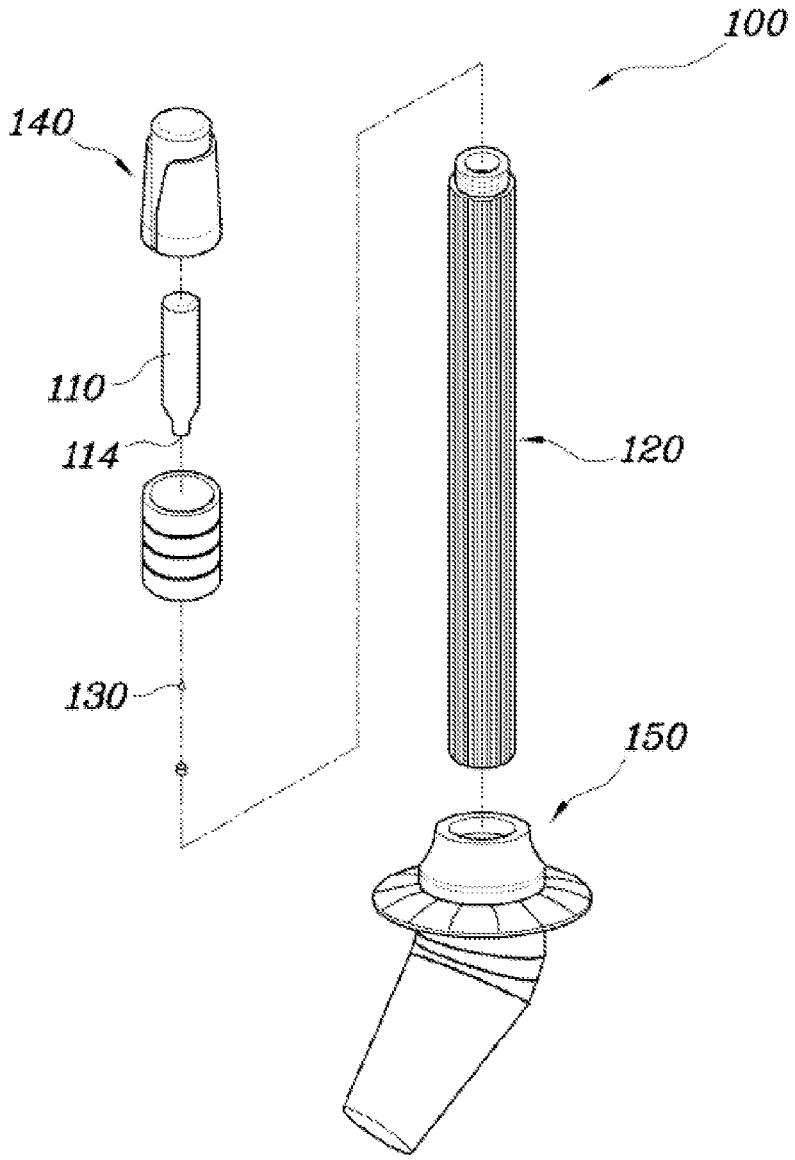
Prior Art FIG. 1
FIG. 1 is a perspective view showing an unclogging device for a toilet according to the related art.

First, in the specification, in adding reference numerals to components throughout the drawings, it is to be noted that like reference numerals designate like components even though components are shown in different drawings. In describing the present invention, well-known functions or constructions will not be described in detail since they may unnecessarily obscure the understanding of the present invention.

Embodiments of the present invention are described in detail with reference to the accompanying drawings.

Figure 2:
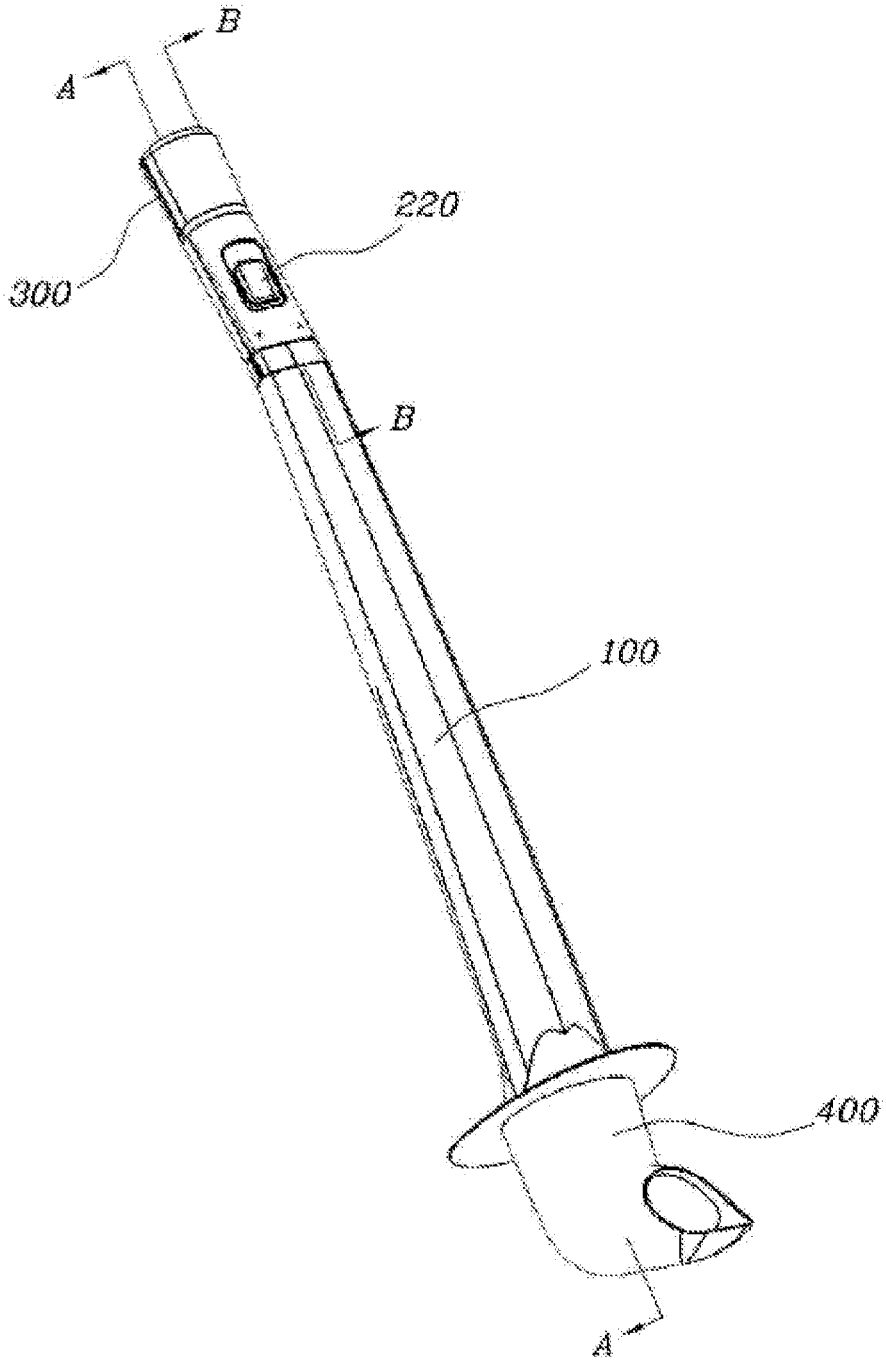
FIG. 2 is a perspective view of a toilet purging device according to the present invention, seen in a direction.
Figure 3A:
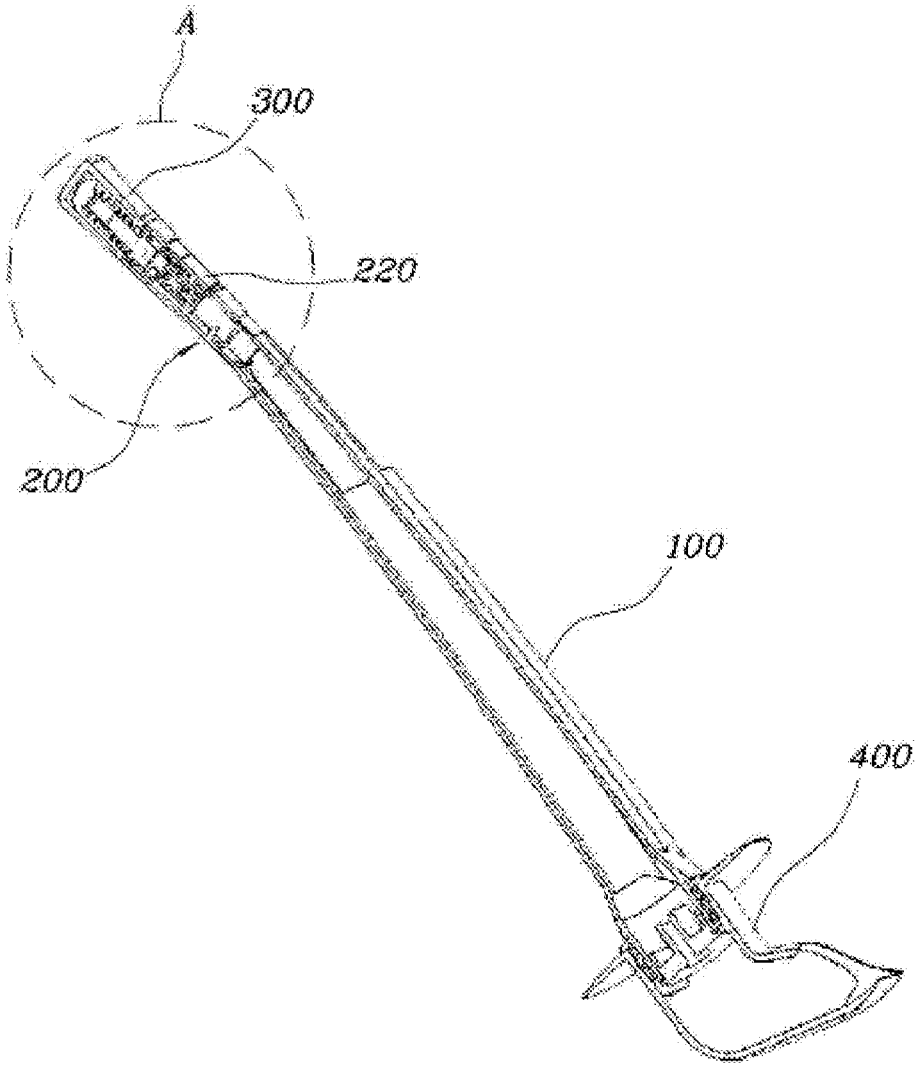
FIG. 3A is a perspective cross-sectional view showing the device taken along the line A-A in FIG. 2, according to an embodiment of the present invention.
Figure 3B:
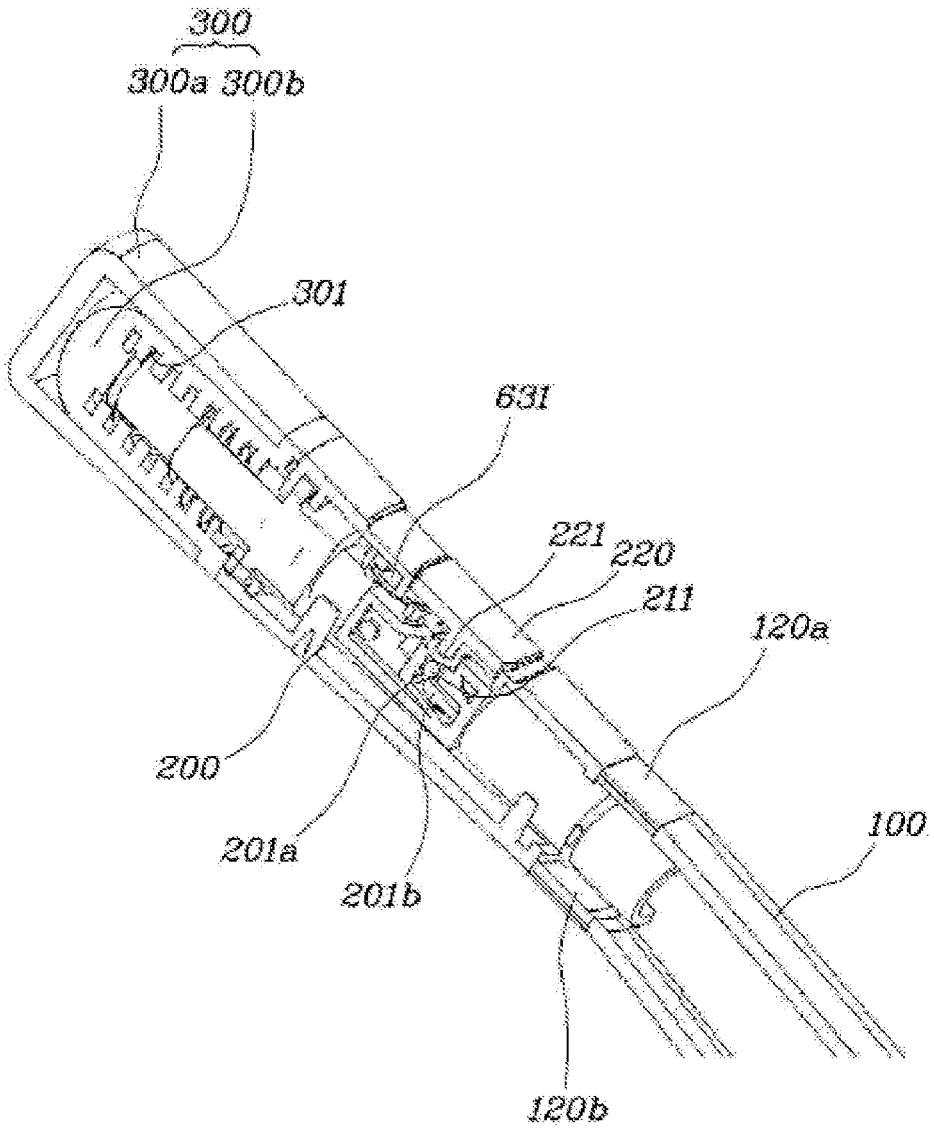
FIG. 3B is an enlarged view of the portion A in FIG. 3A.
Figure 4:
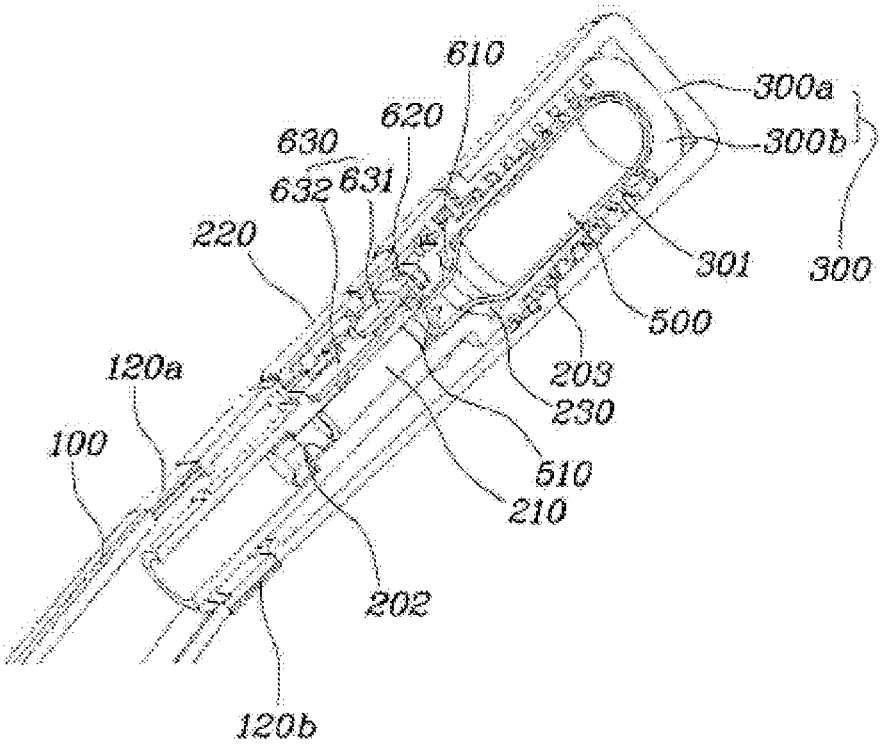
FIG. 4 is a cross-sectional view of the device taken along line B-B in FIG. 2.

FIG. 2 is a perspective view of a toilet purging device according to the present invention, seen in a direction, FIG. 3A is a perspective cross-sectional view showing the device taken along the line A-A in FIG. 2, according to an embodiment of the present invention, FIG. 3B is an enlarged view of the portion A in FIG. 3A, and FIG. 4 is a cross-sectional view of the device taken along line B-B in FIG. 2.

As shown in FIGS. 2 to 4, a toilet purging device according to an embodiment of the present invention includes a pipe body 100, a firing unit 200, a tightening cap 300, and a connector 400, and according to this configuration, the connector 400 is inserted into a clogged drainpipe, with firing ready by turning the tightening cap 300, and then a gas is ejected to the connector 400 by operating a switch of the firing unit 200.

In order to implement the configuration, the pipe body 100, a hollow pipe having a gas channel through it, is manufactured by extruding. Therefore, it is possible to easily manufacture the product, prevent the pipe 100 from being clogged with foreign substances, and provide durability that resists high pressure that is generated when firing the gas.

The pipe body 100 is curved to take the shape of a drainpipe, so that the pipe body 100 can be easily inserted into the drainpipe of a toilet, when it is inserted thereinto. The firing unit 200 is coupled to the upper end of the pipe body 100, between an upper ring member 120*a* and a lower ring member 120*b*.

The firing unit 200 is configured such that a gas is finally ejected, when pushed in a ready-for-firing status, and has a seating groove 230 where a gas container 500 is seated, at the upper portion therein, a spiral male thread 203 on the outer circumference, and a gas channel 202 formed longitudinally therein to communication with the seating groove 230.

In particular, the gas container 500 filled with a high-pressure gas is inserted in the seating groove 230, a female thread 301 of the tightening cap 300 is thread-fastened to the male thread 203, and a firing pin 210 with a locking bar 211 perpendicularly combined is disposed to be longitudinally movable in the gas channel 202, elastically supported to the firing unit 200 through a firing return spring (not shown).

Therefore, as the tightening cap 300 is turned in the forward direction (clockwise), the female thread 301 of the tightening cap 300 is moved forward to the pipe body 100 while turned in the forward direction along the male thread 203 of the firing unit 200, and at the same time, the tightening cap 300 pushes the gas container 500 such that the firing pin 210 passes through an ejection port 510 of the gas container 500, so that firing is ready. The firing pin 210 is kept while it is stopped in a first firing channel 201*a* by the locking bar 211.

A cover bracket 110 is mounted on one side of the firing unit 200 with a switch 220 interposed therebetween. Further, a first firing channel 201*a* that guides the locking bar 211 in the width direction of the firing unit 200 when the switch 220 is pushed and a second firing channel 201*b* that connected to the first channel 201*a* in an L-shape to guide the locking bar 211 moved from the first firing channel 201*a* to the pipe body 100, are formed at the other side of the firing unit 200.

One side of the switch 220 protrudes through a switch hole 111 of the cover bracket 110 and the other side of the switch 220 diverges into two parts, in which one end 221 of the other side of the switch 220 is in contact with the locking bar 211 to be supported and the other end (not shown) of the other side of the switch 220 is elastically connected to the firing unit 200 by a switch return spring (not shown).

Therefore, when firing is ready and the switch 220 is pushed, the end 221 of the other side of the switch 220 pushes the locking bar 211 to be moved along the first firing channel 201*a* and the locking bar 211 that has moved in the width direction of the firing unit 200 along the first firing channel 201*a* moves to the pipe body 100 along the second firing channel 201*b*, thereby firing the gas.

That is, as the locking bar 211 moves to the pipe body 100 along the second firing channel 201*b*, the firing pin 210 closing the ejection port 510 of the gas container 500 is moved to the pipe body 100 along the gas channel 202 of the firing unit 200 by gas pressure in the gas container 500 and the gas ejected from the ejection port 510 of the gas container 500 is ejected to the connector 400 through the pipe body 100.

Figure 5:
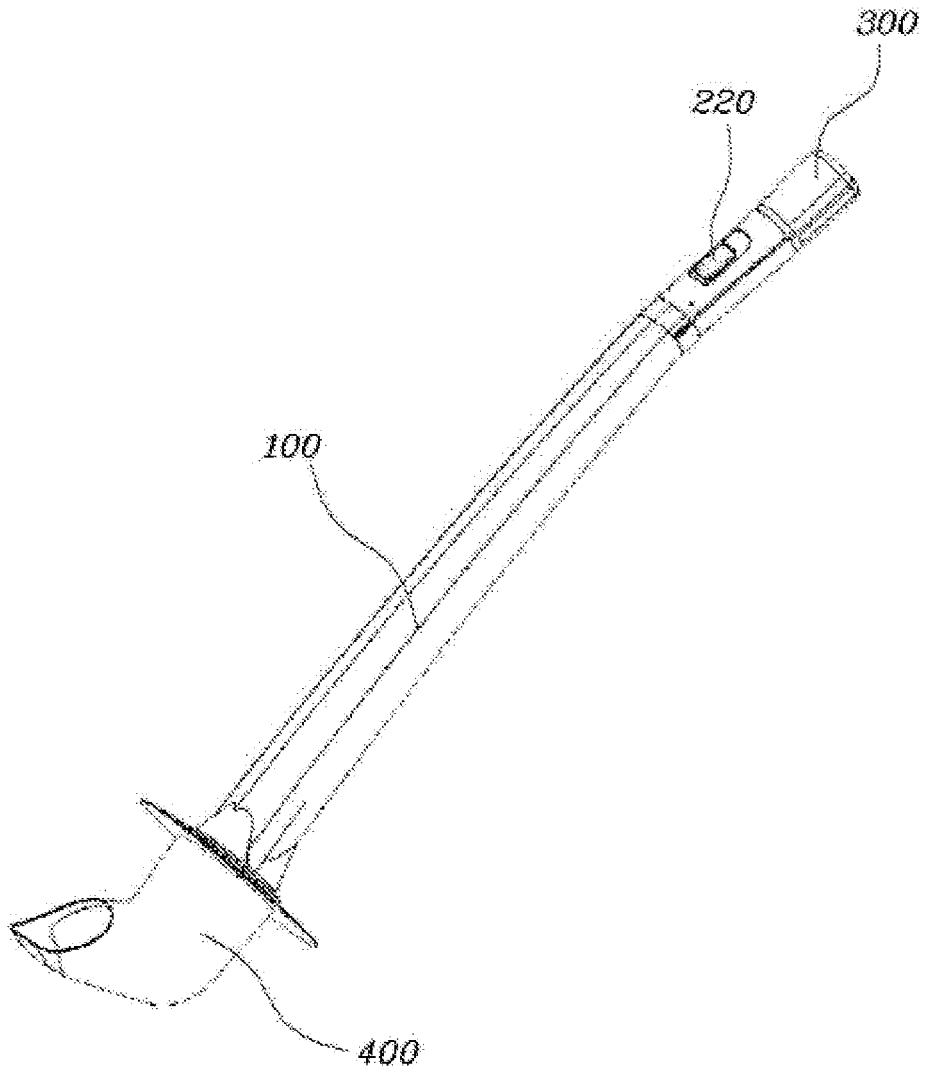
FIG. 5 is a perspective view of the toilet purging device according to the present invention, seen in another direction.
Figure 6:
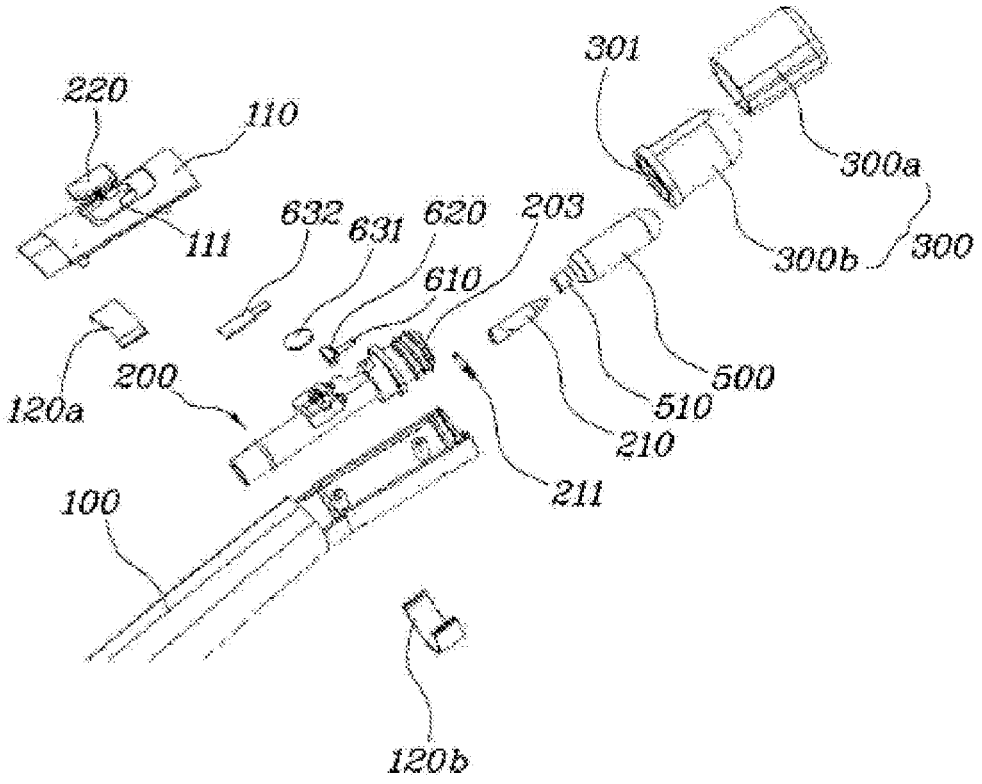
FIG. 6 is an exploded perspective view of the toilet purging device shown in FIG. 5.
Figure 7A:
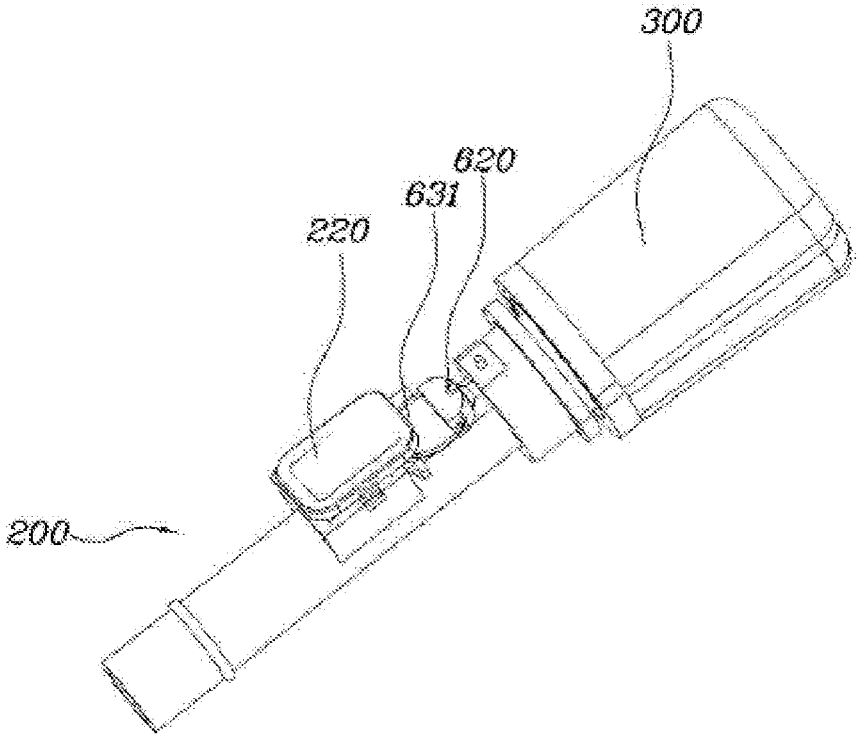
FIGS. 7A and 7B are views enlarging a firing unit in the toilet purging device shown in FIG. 5.
Figure 7B:
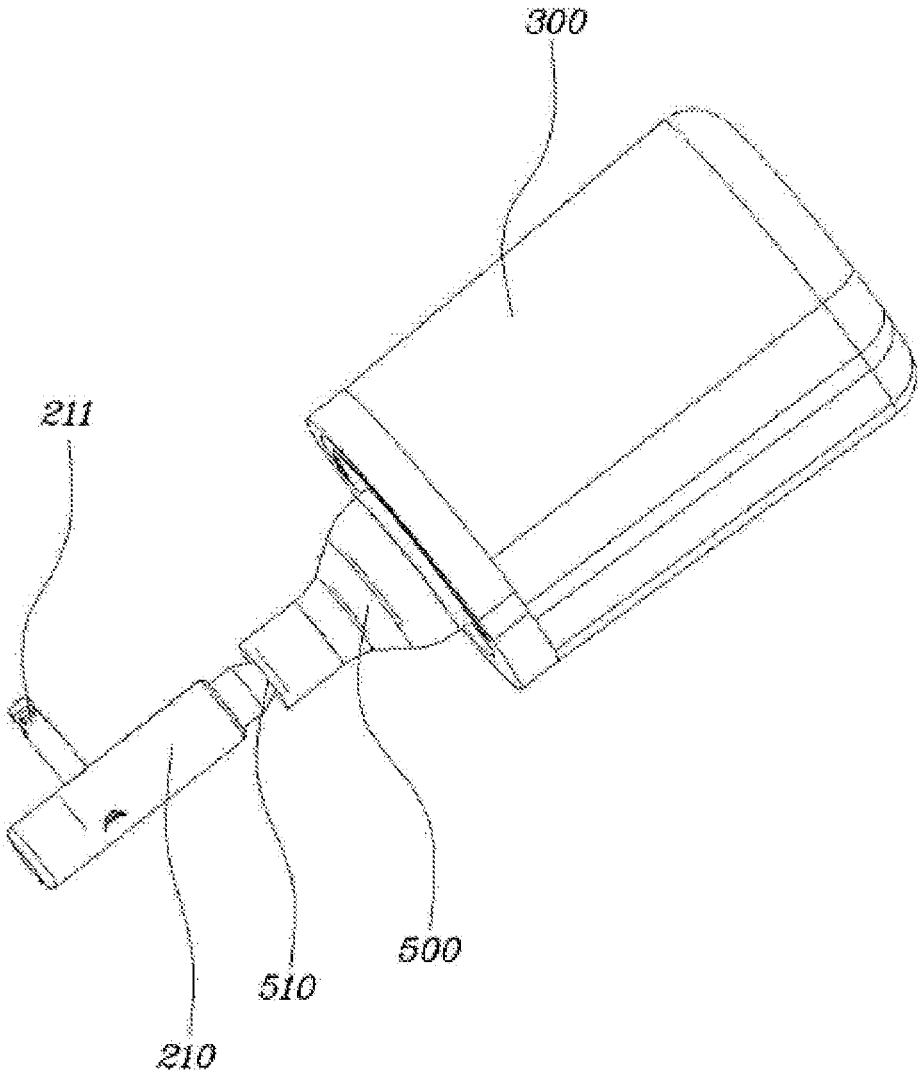

FIG. 5 is a perspective view of the toilet purging device according to the present invention, seen in another direction, FIG. 6 is an exploded perspective view of the toilet purging device shown in FIG. 5, and FIGS. 7A and 7B are views enlarging a firing unit in the toilet purging device shown in FIG. 5.

As shown in FIGS. 5 to 7, the tightening cap 300 is coupled to the top of the firing unit 200. The tightening cap 300 is composed of a tightening cover 300*a* and a tightening stopper 300*b*, and a female thread 301 that engages with the male thread 203 of the firing unit 200 is formed around the inner side of the tightening stopper 300*b*.

Further, the firing unit 200 includes a lamp structure notifies to the user that the gas container 500 comes in contact with the firing pin 210.

For example, the firing unit 200 includes a switch unit 610, a lamp unit 620, and a power circuit unit 630 wherein the switch unit 610 is disposed in the seating groove 230 of the firing unit 200, with the front end protruding, and is pressed by the gas container 500 when the gas container 500 comes in close contact with the firing pin 210, the lamp unit 620 is turned on when power is supplied, and the power circuit unit 630 is composed of a battery 631 and a circuit board 632 and supplies power to the lamp unit 620, when the switch unit 610 is pressed by the gas container 500.

Therefore, when the gas container 500 is brought in close contact with the firing pin 210 by turning the tightening cap 300, the gas container 500 pushes the front end of the switch unit 610, and as the front end of the switch unit 610 is pushed by the gas container 500, the power circuit unit 630 supplies power to the lamp unit 620 and the lamp unit 620 is turned on. The user can recognize that the toilet purging device according to the present invention is ready for firing, by means of the turned-on lamp unit 620.

The operational process of the toilet purging device according to the present invention as described-above will be described hereafter.

First, a user inserts the connector 400 into the clogged drainpipe of a toilet and then inserts the gas container 500 into the seating groove 230 of the firing unit 200 with the ejection port 510 of the gas container 500 facing the pipe body 100, with the tightening cap 300 separated from the firing unit 200 by turning the tightening cap 300 in the forward direction (counterclockwise).

Thereafter, the user combines the tightening cap 300 with the firing unit 200 and readies the device for firing by turning the tightening cap 300 in the forward direction (clockwise). For example, as the tightening cap 300 is turned in the forward direction, the female thread 301 of the tightening cap 300 is moved forward to the pipe body 100 while turned in the forward direction along the male thread 203 of the firing unit 200, and at the same time, the tightening cap 300 pushes the gas container 500 such that the firing pin 210 passes through an ejection port 510 of the gas container 500, so that firing is ready. In this process, the front end of the switch unit 610 is pushed by the gas container 500 and the lamp unit 620 is turned on.

When the switch 220 is pushed while the firing has been ready, the switch 220 pushes the locking bar 211, the locking bar 211 pushed by the switch 220 moves along the first firing channel 201*a* and the second firing channel 201*b*, and accordingly, the firing pin 210 closing the ejection port 510 of the gas container 500 moves to the pipe body 100 with the movement of the locking bar 211, so that the gas is ejected from the gas container 500.

The gas ejected through the ejection port 510 from the gas container 500 is ejected to the container 400 through the pipe body 100, so that the clogged drainpipe of the toilet is unclogged.

Figure 8:
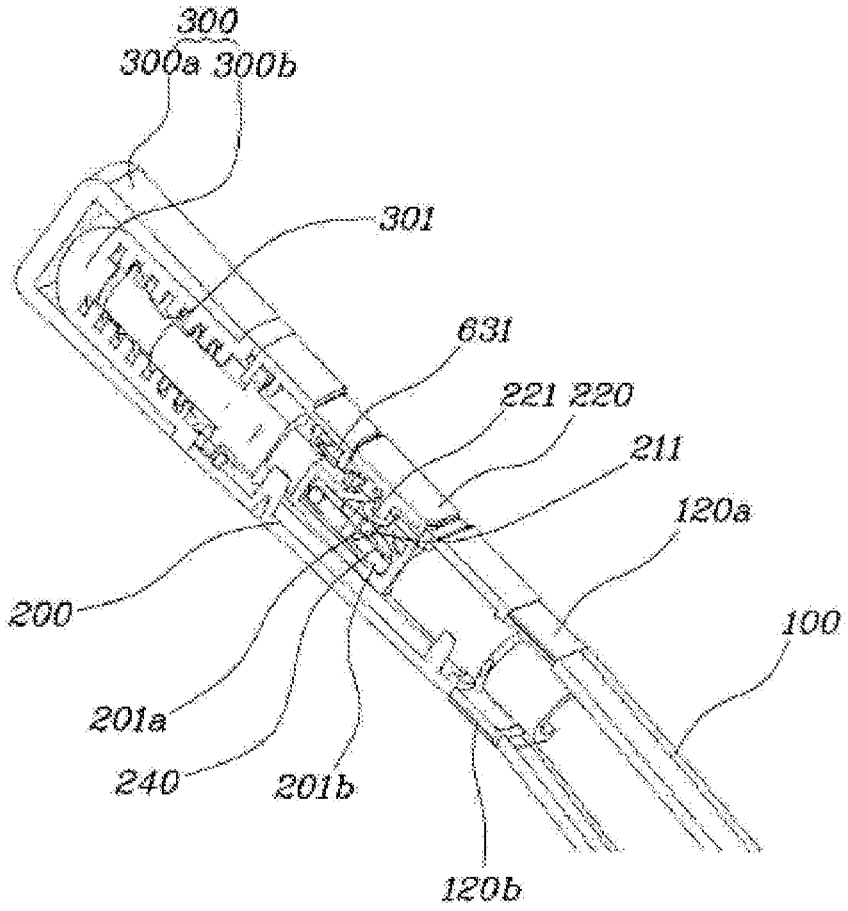
FIG. 8 is a perspective cross-sectional view showing the device taken along the line A-A in FIG. 2, according to another embodiment of the present invention.

FIG. 8 is a perspective cross-sectional view showing the device taken along the line A-A in FIG. 2, according to another embodiment of the present invention.

Meanwhile, as shown in FIG. 8, a toilet purging device according to another embodiment of the present invention may include a pipe body 100, a firing unit 200, a tightening cap 300, a connector 400, and a guide spring 240. The configurations of the pipe body 100, the firing unit 200, the tightening cap 300, and the connector 400 according to another embodiment are the same as those of the pipe body 100, the firing unit 200, the tightening cap 300, and the connector 400 according to the embodiment described above, and the detailed descriptions thereof are not provided.

However, the guide spring 240 is a Z-shaped spring for smoothly moving the locking bar 211 of the firing pin 210 from a first firing channel 201*a* to a second firing channel 201*b* when the switch 220 is pushed, in which one side is fixed to the firing unit 200 and the locking bar 211 is movably held by the other side.

As described above, the present invention has the advantage of being able to safely and conveniently unclog a clogged drain and a clogged toilet, because a user is allowed to eject a gas to a correct position after accurately estimating the point of timing of ejecting the gas and to make sure the read for firing before ejecting the gas by means of the lamp unit, by implementing a two-step operation structure that ejects the gas after the switch is operated.

Although the present invention was described above in detail by means of embodiments, the present invention is not limited to the specific embodiments and should be construed on the basis of claims. Further, it should be understood that the present invention may be changed and modified in various ways by those skilled in the art without departing from the scope of the present invention.

The invention claimed is:

1. A toilet purging device comprising:
a pipe body that has a gas channel through the pipe body;
a firing unit that includes
a firing pin disposed to be longitudinally movable, and
a switch for moving the firing pin to the pipe body when pushed, and coupled to an upper end of the pipe body;
a tightening cap that is thread-fastened to a top of the firing unit with a gas container interposed therebetween and that moves the gas container to be in close contact with the firing pin when turned; and
a connector that is coupled to a lower end of the pipe body and inserted into a drainpipe of a toilet,
wherein the firing unit includes
a switch unit that is disposed with a front end of the switch unit protruding through a seating groove of the firing unit and is pressed by the gas container when the gas container comes in contact with the firing pin,
a lamp unit, and
a power circuit unit that supplies power to the lamp unit when the switch unit is pressed by the gas container.

2. The device of claim 1, further comprising a locking bar connected perpendicularly to a lower portion of the firing pin, and
the firing unit has
a first firing channel that guides the locking bar in the width direction of the firing unit when the switch is pushed, and
a second firing channel that is connected in a curve shape to the first firing channel and guides the locking bar to the pipe body by means of gas pressure.

3. The device of claim 2, wherein the firing unit has a Z-shaped guide spring for continuously and smoothly moving the locking bar of the firing pin to the second firing channel from the first firing channel.

4. The device of claim 1, wherein the gas container is inserted into the seating groove, and the seating groove is formed at an upper portion of the firing unit, and
a gas channel through which the firing pin moves is formed in the firing unit to longitudinally extend and communicate with the seating groove.

5. The device of claim 1, further comprising:
a switch return spring; and
a firing return spring,
wherein the switch is elastically connected to a portion of the firing unit by the switch return spring and the firing pin is elastically supported to another portion of the firing unit by the firing return spring.

6. A toilet purging device comprising:
a pipe body having a gas channel;
a firing unit that includes
a firing pin disposed so as to be movable, and
a switch for moving the firing pin to the pipe body when the switch is pushed, the switch being coupled to an upper end of the pipe body;
a tightening cap that is thread-fastened to a top of the firing unit so as to allow for a gas container to be interposed therebetween, and that is configured to position the gas container to be in contact with the firing pin; and a connector that is coupled to a lower end of the pipe body and inserted into a drainpipe of a toilet, wherein the firing unit includes a switch unit that is disposed in a seating groove of the firing unit, the switch unit being configured to be pressed by the gas container when the gas container comes in contact with the firing pin, a lamp unit, and a power circuit unit that is responsive to the switch unit being pressed by the gas container by supplying power to the lamp unit so that the lamp unit is turned on.

* * * * *